US009006160B2

(12) United States Patent
McDougall

(10) Patent No.: US 9,006,160 B2
(45) Date of Patent: Apr. 14, 2015

(54) LUBRICATING OIL COMPOSITIONS CONTAINING EPOXIDE ANTIWEAR AGENTS

(71) Applicant: Patrick J. McDougall, Berkeley, CA (US)

(72) Inventor: Patrick J. McDougall, Berkeley, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 14/051,607

(22) Filed: Oct. 11, 2013

(65) Prior Publication Data

US 2014/0038869 A1 Feb. 6, 2014

Related U.S. Application Data

(62) Division of application No. 13/920,289, filed on Jun. 18, 2013, now Pat. No. 8,859,474, which is a division of application No. 12/751,652, filed on Mar. 31, 2010, now Pat. No. 8,486,873.

(51) Int. Cl.

| | |
|---|---|
| ***C10M 169/04*** | (2006.01) |
| ***C10M 129/18*** | (2006.01) |
| ***C10M 129/66*** | (2006.01) |
| ***C10M 105/18*** | (2006.01) |

(52) U.S. Cl.

CPC ..... *C10M 129/18* (2013.01); *C10M 129/66* (2013.01); *C10M 169/04* (2013.01); *C10M 2203/1025* (2013.01); *C10M 2207/028* (2013.01); *C10M 2207/042* (2013.01); *C10M 2207/046* (2013.01); *C10M 2207/24* (2013.01); *C10M 2207/289* (2013.01); *C10M 2215/064* (2013.01); *C10M 2215/08* (2013.01); *C10M 2215/22* (2013.01); *C10M 2215/28* (2013.01); *C10M 2219/044* (2013.01); *C10M 2219/046* (2013.01); *C10M 2223/045* (2013.01); *C10M 2227/09* (2013.01); *C10N 2230/06* (2013.01); *C10N 2230/12* (2013.01)

(58) Field of Classification Search

CPC ..... C10M 129/18; C10M 129/20; C10M 129/66; C10M 129/68; C10M 2207/042; C10M 2207/28

USPC ..... 508/304, 454, 484, 494; 123/1 A

See application file for complete search history.

(56) References Cited

U.S. PATENT DOCUMENTS

| | | | | |
|---|---|---|---|---|
| 2,684,943 | A | 7/1954 | Baker | |
| 3,180,832 | A | 4/1965 | Furey | |
| 3,273,981 | A | 9/1966 | Furey | |
| 3,281,358 | A | 10/1966 | Furey | |
| 4,244,829 | A * | 1/1981 | Coupland et al. | 508/304 |
| 4,510,062 | A | 4/1985 | Nakanishi | |
| 4,522,734 | A | 6/1985 | Horodysky et al. | |
| 4,584,115 | A | 4/1986 | Davis | |
| RE32,246 | E | 9/1986 | Horodysky et al. | |
| 4,629,580 | A | 12/1986 | Holstedt et al. | |
| 4,657,686 | A | 4/1987 | Holstedt et al. | |
| 4,778,612 | A | 10/1988 | Wirth et al. | |
| 4,943,383 | A | 7/1990 | Avery et al. | |
| 5,141,661 | A | 8/1992 | DeRosa et al. | |
| 5,366,646 | A * | 11/1994 | Sato et al. | 508/262 |
| 5,851,964 | A | 12/1998 | Furey et al. | |
| 5,880,072 | A | 3/1999 | Furey et al. | |
| 2005/0245402 | A1 | 11/2005 | Yagishita | |
| 2006/0090393 | A1 * | 5/2006 | Rowland et al. | 44/353 |
| 2007/0257229 | A1 | 11/2007 | Tagawa et al. | |
| 2011/0023531 | A1 | 2/2011 | Kaneko et al. | |

FOREIGN PATENT DOCUMENTS

| | | | |
|---|---|---|---|
| EP | 1535985 | A1 | 6/2005 |
| JP | 6-088087 | | 3/1994 |
| JP | 7-188689 | | 7/1995 |
| JP | 2005-261948 | | 9/2006 |
| JP | 2009155547 | A | 7/2009 |
| WO | 2008074760 | A1 | 6/2008 |

OTHER PUBLICATIONS

The Office Action issued in counterpart Japanese Patent Application No. 2013-502592 dated Sep. 16, 2014.

B. M. and Melvin, L. S., Sulfur Yides Emerging Synthetic Intermediates; Academic Press: New York (1975) pp. 51-76.

Gerhartz, W., Yamamoto Y. S., Kaudy, L., Rounsaville, J. F., Schulz, G. eds; Ullmann's Encyclopedia of Industrial Chemistry: VCH, New York, vol. A9, pp. 534-537.

Publication 1509, 14th Edition, Addendum I, Dec. 1998.

Rosen, T., Trost, B. M., Gleming, I., Heathcock, C. H., eds (Comprehensive Organic Synthesis) Pergamon: Oxford, vol. 2, pp. 409-439 (1991).

"The Formation of Polymeric Films Directly Rubbing Surfaces to Reduce Wear", Wear, 26, pp. 369-392 (1973).

Yamaguchi, E. S. "Friction and Wear Measurements Using a Modified MTM Tribometer", IP.com Journal 7, vol. 2, 9, pp. 57-58 (Aug. 2002), No. IPCOM000009117D.

The Singapore Written Opinion issued in counterpart Singapore Patent Application No. 201206784-9 dated Dec. 19, 2013.

* cited by examiner

*Primary Examiner* — Pamela H Weiss

(57) ABSTRACT

A lubricating oil composition comprising (a) a major amount of an oil of lubricating viscosity; and (b) an oil soluble epoxide compound having the following structure:

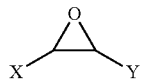

wherein X is hydrogen or a substituted or unsubstituted $C_1$ to $C_{20}$ hydrocarbyl group, wherein the substituted hydrocarbyl group is substituted with one or more substituents selected from hydroxyl, alkoxy, ester or amino groups and Y is —$CH_2OR$, —C(=O)$OR^1$ or —C(=O)$NHR^2$, wherein R, $R^1$ and $R^2$ are independently hydrogen or $C_1$ to $C_{20}$ alkyl or alkenyl groups; and further wherein the oil of lubricating viscosity does not contain a carboxylic acid ester.

20 Claims, No Drawings

LUBRICATING OIL COMPOSITIONS CONTAINING EPOXIDE ANTIWEAR AGENTS

PRIORITY

This application is a divisional of 13/920,289 filed Jun. 18, 2013, which is a divisional of U.S. patent application Ser. No. 12/751,652, filed Mar. 31, 2010, now issued as U.S. Pat. No. 8,486,873 the contents of which are incorporated herein by reference.

FIELD OF THE INVENTION

The present invention generally is directed to epoxide compositions for use in lubricating oil compositions and to the formation of protective films, i.e. antiwear films in components to be lubricated therefrom. More particularly, it is directed to a class of non-phosphorus and non-sulfur containing additives suitable for use as antiwear agents in lubricating oil compositions.

BACKGROUND OF THE INVENTION

Zinc dithiophosphates (ZnDTP) have long been used as antiwear additives and antioxidants in engine oils, automatic transmission fluids, hydraulic fluids and the like. Conventional engine oil technology relies heavily on ZnDTP to provide extremely low cam and lifter wear and favorable oxidation protection under severe conditions. ZnDTP operates under mixed-film lubrication conditions by reacting with rubbing metal surfaces to form protective lubricating films. The mixed-film lubrication regime is a mixture of full-film (hydrodynamic) lubrication wherein the lubricating film is sufficiently thick to prevent metal-to-metal contact and boundary lubrication wherein the lubricating film thickness is significantly reduced and more direct metal-to-metal contact occurs.

However, a problem has arisen with respect to the use of ZnDTP, because phosphorus and sulfur derivatives poison catalyst components of catalytic converters. This is a major concern as effective catalytic converters are needed to reduce pollution and to meet governmental regulations designed to reduce toxic gases such as, for example, hydrocarbons, carbon monoxide and nitrogen oxides, in internal combustion engine exhaust emission. Therefore, it would be desirable to reduce the phosphorus and sulfur content in engine oils so as to maintain the activity and extend the life of the catalytic converter.

There is also governmental and automotive industry pressure towards reducing the phosphorus and sulfur content. As the environmental regulations governing tailpipe emissions have tightened, the allowable concentration of phosphorus in engine oils has been significantly reduced with further reductions in the phosphorus content of engine oils being likely in the next category, for example, GF-5 to perhaps 500 ppm.

However, simply decreasing the amount of ZnDTP presents problems because this necessarily lowers the antiwear properties and oxidation-corrosion inhibiting properties of the lubricating oil. Therefore, it is necessary to find a way to reduce phosphorus and sulfur content while still retaining the antiwear and oxidation-corrosion inhibiting properties of the higher phosphorus and sulfur content engine oils.

Accordingly, as demand for further decrease of the phosphorus content and a limit on the sulfur content of lubricating oils is very high, this reduction cannot be satisfied by the present measures in practice and still meet the severe antiwear and oxidation-corrosion inhibiting properties required of today's engine oils. Thus, it would be desirable to develop lubricating oils, and additives and additive packages therefor, having lower levels of phosphorus and sulfur but which still provide the needed wear and oxidation-corrosion protection now provided by lubricating oils having, for example, higher levels of ZnDTP, but which do not suffer from the disadvantages of the lubricating oils discussed above.

BACKGROUND ART

While not wishing to be bound to any particular theory, it is believed that the epoxides employed in the present invention form protective lubricating films via a process known as tribopolymerization. In the tribopolymerization process, polymer-formers are adsorbed on a solid surface and polymerize under rubbing conditions to form organic polymeric films directly on the rubbing surface. These polymeric films are self-replenishing and reduce wear in metal-on-metal contact. A summary of the tribopolymerization process is disclosed in Furey, M. "The formation of polymeric films directly on rubbing surfaces to reduce wear," *Wear,* 26, 369-392 (1973). According to Furey, useful polymer-formers may be of the condensation-type or of the addition-type. Condensation-type polymerization involves the formation of polyesters, polyamides polyethers, polyanhydrides, etc. by elimination of water or alcohols from bifunctional molecules such as ω-amino-carboxylic acids or glycols, diamines, diesters and dicarboxylic acids. Epoxide-type polymerization is an addition-type polymerization wherein the addition of small molecules of one type to each other results in the opening of a ring without elimination of any part of the molecule. According to Furey, the condensation-type polymerization approach appeared to have been more effective in the systems investigated.

U.S. Pat. No. 3,180,832 discloses lubricity and antiwear additives involving ester reaction products of substantially equimolar quantities of oil-soluble dimer acids with polyols.

U.S. Pat. No. 3,273,981 discloses lubricity and antiwear additives comprising a dicarboxylic acid and a partial ester of a polyhydric alcohol.

U.S. Pat. No. 3,281,358 discloses lubricity and antiwear additives comprising a reaction product of a dicarboxylic acid and a compound selected from the class consisting of polyamines and hydroxyl amines.

U.S. Pat. No. 5,880,072 discloses a composition for reducing wear of rubbing surfaces comprising a cyclic amide and a monoester formed by reacting a dimer acid with a polyol. The antiwear composition may be used in conjunction with, or in place of, ZnDTP in lubricating oils.

U.S. Pat. No. 5,851,964 discloses a method of reducing wear of rubbing surfaces using cyclic amides. The cyclic amides may be used in conjunction with, or in place of, ZnDTP in lubricating oils.

Epoxides are known as additives for lubricating oils.

U.S. Pat. No. 4,244,829 discloses epoxidized fatty acid esters as lubricity modifiers for lubricating oils.

U.S. Pat. No. 4,943,383 discloses epoxidized poly alpha-olefin oligomers that possess improved wear resistant characteristics.

Japanese Patent Provisional Publication 2009-155547 discloses a lubricating oil composition for metal working with wear prevention properties which comprises an epoxidized cyclohexyl diester.

In addition, borated epoxides are useful antiwear additives for lubricating oils.

Reissued U.S. Pat. No. 32,246 discloses lubricant compositions containing a product made by reacting a boronating agent with a hydrocarbyl epoxide.

U.S. Pat. No. 4,522,734 discloses lubricant compositions comprising borate esters of hydrolyzed hydrocarbyl epoxides.

U.S. Pat. No. 4,584,115 discloses a method for making borated epoxides wherein the epoxide contains at least eight carbon atoms.

U.S. Pat. No. 4,778,612 discloses metal boric acid complexes derived from epoxides.

SUMMARY OF THE INVENTION

One embodiment of the present invention is directed to a lubricating oil composition comprising (a) a major amount of an oil of lubricating viscosity; and (b) an oil soluble epoxide compound having the following structure:

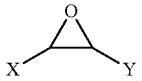

wherein X is hydrogen or a substituted or unsubstituted $C_1$ to $C_{20}$ hydrocarbyl group, wherein the substituted hydrocarbyl group is substituted with one or more substituents selected from hydroxyl, alkoxy, ester or amino groups and Y is $—CH_2OR$, $—C(=O)OR^1$ or $—C(=O)NHR^2$, wherein R, $R^1$ and $R^2$ are independently hydrogen or $C_1$ to $C_{20}$ alkyl or alkenyl groups; and further wherein the oil of lubricating viscosity does not contain a carboxylic acid ester.

One embodiment of the present invention is directed to a lubricating oil additive concentrate comprising from about 90 weight percent to about 10 weight percent of an organic liquid diluent and from about 10 weight percent to about 90 weight percent of an oil soluble epoxide compound having the following structure:

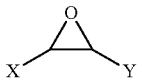

wherein X is hydrogen or a substituted or unsubstituted $C_1$ to $C_{20}$ hydrocarbyl group, wherein the substituted hydrocarbyl group is substituted with one or more substituents selected from hydroxyl, alkoxy, ester or amino groups, and Y is $—CH_2OR$, $—C(=O)OR^1$ or $—C(=O)NHR^2$, wherein R, $R^1$ and $R^2$ are independently hydrogen or $C_1$ to $C_{20}$ alkyl or alkenyl groups; and further wherein the organic liquid diluent does not contain a carboxylic acid ester.

One embodiment of the present invention is directed to a method of reducing wear in an internal combustion engine comprising operating the internal combustion engine with a lubricating oil composition comprising (a) a major amount of an oil of lubricating viscosity; and (b) an oil soluble epoxide compound having the following structure:

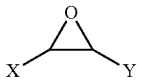

wherein X is hydrogen or a substituted or unsubstituted $C_1$ to $C_{20}$ hydrocarbyl group, wherein the substituted hydrocarbyl group is substituted with one or more substituents selected from hydroxyl, alkoxy, ester or amino groups and Y is $—CH_2OR$, $—C(=O)OR^1$ or $—C(=O)NHR^2$, wherein R, $R^1$ and $R^2$ are independently hydrogen or $C_1$ to $C_{20}$ alkyl or alkenyl groups; and further wherein the oil of lubricating viscosity does not contain a carboxylic acid ester.

DETAILED DESCRIPTION OF THE INVENTION

As used herein, the following terms have the following meaning unless expressly stated to the contrary:

The term "alkyl" means a straight- or branched-chain saturated hydrocarbyl substituent (i.e., a substituent containing only carbon and hydrogen).

The term "alkenyl" means a straight- or branched-chain hydrocarbyl substituent containing at least one carbon-carbon double bond.

The term "cycloalkyl" means a saturated carbocyclyl substituent.

The term "alkcycloalkyl" means a cycloalkyl group substituted with an alkyl group.

The term "aryl" means an aromatic carbocyclyl substituent.

The term "alkaryl" means an aryl group substituted with an alkyl group.

The term "arylalkyl" means an alkyl group substituted with an aryl group.

The term "substantially free of phosphorus" means that the lubricating oil composition contains no more than 0.02 weight % phosphorus.

Epoxide

The epoxide compounds employed in the present invention may be prepared by the epoxidation of an allyl ether, α,β-unsaturated ester or α,β-unsaturated amide to the corresponding glycidyl ether, glycidic ester or glycidic amide, respectively. An olefin may be epoxidized with hydrogen peroxide and an organic peracid. Suitable organic peracids include peracetic acid, 3-chloroperbenzoic acid, and magnesium monoperoxyphthalate and the like. Alternatively, the olefin may also be epoxidized in the presence of a transition metal catalyst and a co-oxidant. Suitable co-oxidants include hydrogen peroxide, tert-butyl hydroperoxide, iodosylbenzene, sodium hypochlorite and the like. Sienel, G., Rieth, R., and Rowbottom, K. T. (in *Ullmann's Encyclopedia of Industrial Chemistry*; Gerhartz, W., Yamamoto, Y. S., Kaudy, L., Rounsaville, J. F., Schulz, G., eds.; VCH: New York, volume A9, pp. 534-537) disclose methods for epoxidation using hydrogen peroxide, organic peracids and hydroperoxides. The epoxide compounds employed in the present invention may also be prepared by the condensation of sulfur ylides with an aldehyde or ketone. Trost, B. M. and Melvin, L. S. (in *Sufur Ylides Emerging Synthetic Intermediates*; Academic Press: New York, 1975, pp. 51-76) disclose methods for preparing epoxides from sulfur ylides. Additionally, glycidic esters employed in the present invention may also be prepared by Darzens condensation of an α-halo ester and an aldehyde or ketone, in the presence of a base. Rosen, T. (in *Comprehensive Organic Synthesis*; Trost. B. M., Fleming, I., Heathcock, C. H., eds.; Pergamon: Oxford, 1991, volume 2, pp. 409-439) discloses methods for preparing glycidic esters via Darzens condensation.

Preferably, the epoxide compounds employed in the present invention are prepared by the epoxidation of an allyl ether, α,β-unsaturated ester or α,β-unsaturated amide, or mixtures thereof, with hydrogen peroxide or an organic peracid. More preferably, the epoxide compounds employed in the present invention are prepared the epoxidation of an allyl ether, α,β-unsaturated ester or α,β-unsaturated amide, or mixtures thereof, with hydrogen peroxide.

Typically, the oil soluble epoxide compounds have the following structure:

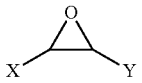

wherein X is hydrogen or a substituted or unsubstituted $C_1$ to $C_{20}$ hydrocarbyl group, wherein the substituted hydrocarbyl group is substituted with one or more substituents selected from hydroxyl, alkoxy, ester or amino groups and Y is —$CH_2OR$, —C(=O)$OR^1$ or —C(=O)$NHR^2$, wherein R, $R^1$ and $R^2$ are independently hydrogen or $C_1$ to $C_{20}$ alkyl or alkenyl groups.

In one embodiment, the oil soluble epoxide compounds employed in the present invention are glycidyl ethers or glycidol having the following structure:

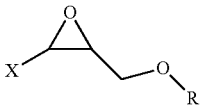

wherein X is hydrogen or a substituted or unsubstituted $C_1$ to $C_{20}$ hydrocarbyl group, wherein the substituted hydrocarbyl group is substituted with one or more substituents selected from hydroxyl, alkoxy, ester or amino groups, and wherein R is hydrogen or a $C_1$ to $C_{20}$ alkyl or alkenyl group. When X and R are both hydrogen, the epoxide compound is glycidol or 2,3-epoxy-1-propanol. The $C_1$ to $C_{20}$ hydrocarbyl group is a straight- or branched-chain alkyl, cycloalkyl, alkcycloalkyl, aryl, alkaryl, or arylalkyl. Examples of alkyl groups include methyl, ethyl, propyl, isopropyl, n-butyl, isobutyl, sec-butyl, tert-butyl, pentyl, iso-amyl, hexyl, 2-ethylhexyl, octyl and dodecyl. The cycloalkyl group contains from 3 to about 14 carbon ring atoms. A cycloalkyl group may be single carbon ring or may be 2 or 3 carbon rings fused together. Examples of single-ring cycloalkyls include cyclopropyl, cyclopentyl and cyclohexyl. The aryl group contains from 6 to 14 carbon ring atoms. Examples of aryls include phenyl and naphthalenyl. Examples of arylalkyl substituents include benzyl, phenylethyl, and (2-naphthyl)-methyl. Examples of alkenyl groups include vinyl, allyl, isopropenyl, butenyl, isobutenyl, tert-butenyl, pentenyl, and hexenyl. In one embodiment, the $C_1$ to $C_{20}$ hydrocarbyl group is an alkyl group of 1 to 6 carbon atoms.

In one embodiment, X is hydrogen. When X is hydrogen, preferred compounds include glycidol, allyl 2,3-epoxypropyl ether, isopropyl 2,3-epoxypropyl ether, (tert-butoxymethyl) oxirane and [[(2-ethylhexyl)oxy]methyl]oxirane, with glycidol being particularly preferred. Glycidol is available commercially from Richman Chemical (Lower Gwynedd, Pa.). Allyl 2,3-epoxypropyl ether is available commercially from Richman Chemical and from Raschig (Ludwigshafen, Germany). Isopropyl 2,3-epoxypropyl ether, (tert-butoxymethyl) oxirane and [[(2-ethylhexyl)oxy]methyloxirane are available commercially from Raschig.

In one embodiment, the oil soluble epoxide compounds employed in the present invention are glycidic esters having the following structure:

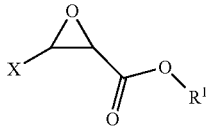

wherein X is hydrogen or a substituted or unsubstituted $C_1$ to $C_{20}$ hydrocarbyl group, wherein the substituted hydrocarbyl group is substituted with one or more substituents selected from hydroxyl, alkoxy, ester or amino groups; and wherein $R^1$ is hydrogen or a $C_1$ to $C_{20}$ alkyl or alkenyl group. The $C_1$ to $C_{20}$ hydrocarbyl group is a straight- or branched-chain alkyl, cycloalkyl, alkcycloalkyl, aryl, alkaryl, or arylalkyl. Examples alkyl groups include methyl, ethyl, propyl, isopropyl, n-butyl, isobutyl, sec-butyl, tert-butyl, pentyl, iso-amyl, hexyl, 2-ethylhexyl, octyl and dodecyl. The cycloalkyl group contains from 3 to about 14 carbon ring atoms. A cycloalkyl group may be single carbon ring or may be 2 or 3 carbon rings fused together. Examples of single-ring cycloalkyls include cyclopropyl, cyclopentyl and cyclohexyl. The aryl group contains from 6 to 14 carbon ring atoms. Examples of aryls include phenyl and naphthalenyl. Examples of arylalkyl substituents include benzyl, phenylethyl, and (2-naphthyl)-methyl. In one embodiment, the $C_1$ to $C_{20}$ hydrocarbyl group is an alkyl group of 1 to 6 carbon atoms.

In one embodiment, X is hydrogen. When X is hydrogen, preferred compounds include methyl 2,3-epoxypropionate, ethyl 2,3-epoxypropionate, propyl 2,3-epoxypropionate, isopropyl 2,3-epoxypropionate, butyl 2,3-epoxypropionate, isobutyl 2,3-epoxypropionate, hexyl 2,3-epoxypropionate, octyl 2,3-epoxypropionate, 2-ethylhexyl 2,3-epoxypropionate, and dodecyl 2,3-epoxypropionoate, with butyl 2,3-epoxypropionoate being particularly preferred.

In one embodiment, the oil soluble epoxide compounds employed in the present invention are glycidic amides having the following structure:

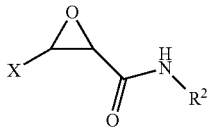

wherein X is hydrogen or a substituted or unsubstituted $C_1$ to $C_{20}$ hydrocarbyl group wherein the substituted hydrocarbyl group is substituted with one or more substituents selected from hydroxyl, alkoxy, ester or amino groups; and wherein $R^2$ is hydrogen or a $C_1$ to $C_{20}$ alkyl or alkenyl group. The $C_1$ to $C_{20}$ hydrocarbyl group is a straight- or branched-chain alkyl, cycloalkyl, alkcycloalkyl, aryl, alkaryl, or arylalkyl. Examples alkyl groups include methyl, ethyl, propyl, isopropyl, n-butyl, isobutyl, sec-butyl, ter-butyl, pentyl, iso-amyl, hexyl, 2-ethylhexyl, octyl and dodecyl. The cycloalkyl group contains from 3 to about 14 carbon ring atoms. A cycloalkyl group may be single carbon ring or may be 2 or 3 carbon rings fused together. Examples of single-ring cycloalkyls include cyclopropyl, cyclopentyl and cyclohexyl. The aryl group contains from 6 to 14 carbon ring atoms. Examples of aryls include phenyl and naphthalenyl. Examples of arylalkyl substituents include benzyl, phenylethyl, and (2-naphthyl)-methyl. In one embodiment, the $C_1$ to $C_{20}$ hydrocarbyl group is an alkyl group of 1 to 6 carbon atoms.

In one embodiment, X is hydrogen. When X is hydrogen, preferred compounds include N-methyl 2,3-epoxypropionamide, N-ethyl 2,3-epoxypropionamide, N-propyl 2,3-epoxypropionamide, N-isopropyl 2,3-epoxypropionamide, N-butyl 2,3-epoxypropionamide, N-isobutyl 2,3-epoxypropionamide, N-tert-butyl 2,3-epoxypropionamide, N-hexyl 2,3-epoxypropionamide, N-octyl 2,3-epoxypropionamide, N-(2-ethylhexyl)-2,3-epoxypropionamide, and N-dodecyl 2,3-epoxypropanionamide, with N-isopropyl 2,3-epoxypropionamide being particularly preferred.

Oil of Lubricating Viscosity

The base oil of lubricating viscosity for use in the lubricating oil compositions of this invention is typically present in a major amount, e.g., an amount of 50 weight percent or greater, preferably greater than about 70 weight percent, more preferably from about 80 to about 99.5 weight percent and most preferably from about 85 to about 98 weight percent, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification: and that is identified by a unique formula, product identification number, or both. The base oil for use herein can be any of those well known in the art as base oils used in formulating lubricating oil compositions for any and all such applications, e.g., engine oils, marine cylinder oils, functional fluids such as hydraulic oils, gear oils, transmission fluids, etc., provided that the oil of lubricating viscosity does not contain a carboxylic acid ester.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C).

Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0 W, 0 W-20, 0 W-30, 0 W-40, 0 W-50, 0 W-60, 5 W, 5 W-20, 5 W-30, 5 W-40, 5 W-50, 5 W-60, 10 W, 10 W-20, 10 W-30, 10 W-40, 10 W-50, 15 W, 15 W-20, 15 W-30 or 15 W-40. Oils used as gear oils can have viscosities ranging from about 2 cSt to about 2000 cSt at 100° C.

Base stocks may be manufactured using a variety of different processes including, but not limited to, distillation, solvent refining, hydrogen processing, oligomerization, and rerefining. Rerefined stock shall be substantially free from materials introduced through manufacturing, contamination, or previous use. The base oil of the lubricating oil compositions of this invention may be any natural or synthetic lubricating base oil provided that the oil of lubricating viscosity does not contain a carboxylic acid ester. Suitable hydrocarbon synthetic oils include, but are not limited to, oils prepared from the polymerization of ethylene or from the polymerization of 1-olefins to provide polymers such as polyalphaolefin or PAO oils, or from hydrocarbon synthesis procedures using carbon monoxide and hydrogen gases such as in a Fischer-Tropsch process. For example, a suitable base oil is one that comprises little, if any, heavy fraction; e.g., little, if any, lube oil fraction of viscosity 20 cSt or higher at 100° C.

The base oil may be derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Group IV base oils are polyalphaolefins (PAO). Group V base oils include all other base oils not included in Group I, II, II, or IV.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, and the like.

Useful synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other useful synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional useful synthetic hydrocarbon oils include liquid polymers of alpha-olefins having the proper viscosity. Especially useful synthetic hydrocarbon oils are the hydrogenated liquid oligomers of $C_6$, to $C_{12}$ alpha-olefins such as, for example, 1-decene trimer.

Another class of useful synthetic lubricating oils include, but are not limited to, alkylene oxide polymers, i.e., homopolymers, interpolymers, and derivatives thereof where the terminal hydroxyl groups have been modified by, for example, etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500-1000, diethyl ether of polypropylene glycol having a molecular weight of 1,000-1,500, etc.).

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl)silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like. Still yet other useful synthetic lubricating oils include, but are not limited to, liquid esters of phosphorous containing acids, e.g., tricresyl phosphate, trioctyl phosphate, diethyl ester of decane phosphionic acid, etc., polymeric tetrahydrofurans and the like.

The lubricating oil may be derived from unrefined, refined and rerefined oils, either natural, synthetic or mixtures of two or more of any of these of the type disclosed herein above. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations or a petroleum oil obtained directly from distillation, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

It is preferred to use a major amount of base oil in the lubricating oil of this invention. A major amount of base oil as defined herein comprises 50 weight % or more, preferably greater than about 70 weight percent, more preferably from about 80 to about 99.5 weight percent and most preferably from about 85 to about 98 weight % of at least one of Group I, II, III and IV base oil. When weight % is used herein, it is referring to weight % of the lubricating oil unless otherwise specified.

Lubricating Oil Composition

Generally, the amount of the epoxide compounds employed in lubricating oils of the present invention is from about 0.01 to about 8 weight %, preferably, from about 0.05 to about 5 weight % and more preferably from about 0.1 to 2 weight %, based on the total weight of the composition.

Additional Additives

The following additive components are examples of components that can be favorably employed in combination with the lubricating oil additive of the present invention. These examples of additives are provided to illustrate the present invention, but they are not intended to limit it.

(A) Metal Detergents: sulfurized or unsulfurized alkyl or alkenyl phenates, alkyl or alkenyl aromatic sulfonates, calcium sulfonates, sulfurized or unsulfurized metal salts of alkyl or alkenyl hydroxybenzoates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multi-acid, and chemical and physical mixtures thereof.

(B) Ashless Dispersants: alkenyl succinimides, alkenyl succinimides modified with other organic compounds, and alkenyl succinimides modified with boric acid, alkenyl succinic ester.

(C) Oxidation Inhibitors:

(1) Phenol type oxidation inhibitors: 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-methyl-6-tert-butyl-phenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-α-dimethylamino-p-cresol, 2,6-di-tert-4(N,N'dimethylaminomethylphenol), 4,4'-thiobis(2-methyl-6-tert-butylphenol), 2,2'-thiobis(4-methyl-6-ter-butylphenol), bis(3-methyl-4-hydroxy-5-tert-butylbenzyl)sulfide, and bis(3,5-di-tert-butyl-4-hydroxybenzyl)sulfide.

(2) Diphenylamine type oxidation inhibitor: alkylated diphenylamine, phenyl-α-naphthylamine, and alkylated α-naphthylamine.

(3) Other types: metal dithiocarbamate (e.g., zinc dithiocarbamate), and methylenebis(dibutyldithiocarbamate).

(D) Rust Inhibitors:

(1) Non ionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate.

(2) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

(E) Demulsifiers: addition product of alkylphenol and ethylene oxide, polyoxyethylene alkyl ether, and polyoxyethylene sorbitane ester.

(F) Extreme Pressure Agents (EP agents): sulfurized oils, diphenyl sulfide, methyl trichlorostearate, chlorinated naphthalene, benzyl iodide, fluoroalkylpolysiloxane, and lead naphthenate.

(G) Wear Inhibitors: zinc dialkyldithiophosphate (ZnDTP, primary alkyl type & secondary alkyl type).

(H) Friction Modifiers: fatty alcohol, fatty acid, amine, borated ester, and other esters.

(I) Multifunctional Additives: sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound.

(J) Viscosity Index Improvers: polymethacrylate type polymers, ethylene-propylene copolymers, styrene-isoprene copolymers, hydrated styrene-isoprene copolymers, polyisobutylene, and dispersant type viscosity index improvers.

(K) Pour-point Depressants: polymethyl methacrylate.

(L) Foam Inhibitors: alkyl methacrylate polymers and dimethyl silicone polymers.

In one embodiment, the lubricating oil composition of the present invention may contain low levels of phosphorus. In one embodiment the lubricating oil composition comprises no more than 0.08 weight % phosphorus. In one embodiment the lubricating oil composition comprises no more than 0.05 weight % phosphorus. In one embodiment, the lubricating oil compositions is substantially free of phosphorus.

In one embodiment, the lubricating oil composition of the present invention may contain low levels of sulfur. In one embodiment the lubricating oil composition comprises no more than 0.5 weight % sulfur. In one embodiment the lubricating oil composition comprises no more than 0.2 weight % sulfur.

Lubricating Oil Additive Concentrate

The present invention is also directed to a lubricating oil additive concentrate in which the additive of the present invention is incorporated into a substantially inert, normally liquid organic diluent such as, for example, mineral oil, naphtha, benzene, toluene or xylene to form an additive concentrate. Typically, a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used provided that the organic liquid diluent does not contain a carboxylic acid ester. Generally, the lubricating oil additive concentrate will contain 90 to 10 weight percent of an organic diluent and from about 10 to 90 weight percent of one or more additives employed in the present invention.

Specifically, the lubricating oil additive concentrate comprises from about 90 weight percent to about 10 weight percent of an organic liquid diluent and from about 10 weight percent to about 90 weight percent of an oil soluble epoxide compound having the following structure:

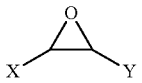

wherein X is hydrogen or a substituted or unsubstituted $C_1$ to $C_{20}$ hydrocarbyl group, wherein the substituted hydrocarbyl group is substituted with one or more substituents selected from hydroxyl, alkoxy, ester or amino groups, and Y is $—CH_2OR$, $—C(=O)OR^1$ or $—C(=O)NHR^2$, wherein R, $R^1$ and $R^2$ are independently hydrogen or $C_1$ to $C_{20}$ alkyl or alkenyl groups; and further wherein the organic liquid diluent does not contain a carboxylic acid ester.

The invention is further illustrated by the following examples, which set forth particularly advantageous method embodiments. While the examples are provided to illustrate the present invention, they are not intended to limit it.

EXAMPLES

Example 1

Butyl 2,3-Epoxy Propionate

A 500 mL round bottom flask was charged with 13.9 g of ammonium bicarbonate, 100 mL of water and 150 mL of acetonitrile. With stirring, 80 mL of a hydrogen peroxide solution (30 wt. % in water) was added to the flask followed by the subsequent addition of 10 mL of butyl acrylate. The reaction mixture was stirred overnight in the dark at room temperature. The mixture was then diluted with 200 mL of water and 200 mL of ethyl acetate. The organic layer collected and washed with a saturated aqueous sodium thiosulfate solution and brine, dried over magnesium sulfate, filtered and concentrated under reduced pressure.

Example 2

N-Isopropyl 2,3-Epoxypropionamide

The epoxide was prepared according to the procedure described in Example 1 except that N-isopropyl acrylamide was used rather than butyl acrylate.

Example 3

N-Butyl 2,3-Epoxypropionamide

The epoxide was prepared according to the procedure described in Example 1 except that N-butyl acrylamide was used rather than butyl acrylate.

Example 4

A lubricating oil composition was prepared by top-treating the base oil of Example A with 0.37 weight % of glycidol (available from Richman Chemical, Lower Gwynedd, Pa.).

Example 5

A lubricating oil composition was prepared by top-treating the base oil of Example A with 0.64 weight % of butyl 2,3-epoxypropionate as prepared in Example 1.

Example 6

A lubricating oil composition was prepared by top-treating the base oil of Example A with 0.70 weight % of N-isopropyl 2,3-epoxypropionamide as prepared in Example 2.

Example 7

A lubricating oil composition was prepared by top-treating the base oil of Example A with 0.72 weight % of N-butyl 2,3-epoxypropionamide as prepared in Example 3.

Example A (Comparative)

This example contained only Chevron 100N Group II base oil.

Example B (Comparative)

A lubricating oil composition was prepared by top-treating the base oil of Example A with 1 weight % of a zinc dialkyl dithiophosphate derived from a mixture of secondary alcohols.

Example C (Comparative)

A lubricating oil composition was prepared by top-treating the base oil of Example A with 0.57 weight % of caprolactam.

Evaluation of Protection Against Wear

The wear performance of lubricating oil compositions containing the epoxide compounds employed in the present invention was tested using a Mini-Traction Machine (MTM) tribometer from PCS Instruments (London, U.K.). Three different MTM bench tests were conducted to more fully assess the wear performance of lubricating oil compositions containing the epoxide compounds employed in the present invention. In the first MTM test, the epoxide compounds employed in the present invention were screened for wear performance in a 100N Group II base oil at a constant load. In the second MTM test, a load increase profile test was run to assess the resistance of some of the same lubricating oil compositions to higher loads. In the third MTM test, fully formulated lubricating oil compositions containing the epoxide compounds employed in the present invention were tested for the ability to inhibit wear to a steel ball that had not been hardened in the normal manufacturing process (soft ball).

For the MTM screener test, the MTM tribometer (PCS Instruments, London, U.K.) was set up to run in pin-on-disk mode using polished disks of 52100 steel from PCS Instruments, and a 0.25 inch stationary ball bearing, also of 52100 steel from Falex Corporation, in place of a pin [Yamaguchi, E. S., "Friction and Wear Measurements Using a Modified MTM Tribometer," IP.com Journal 7, Vol. 2, 9, pp 57-58 (August 2002), No. IPCOM000009117D]. The test was conducted at 100° C. for 40 minutes at 7 Newtons load and a sliding speed of 200 mm/s following a break-in period of 5 minutes at 0.1 Newtons and a sliding speed of 2000 mm/s. The wear scars on the balls are measured manually on an optical microscope and recorded.

For the MTM load increase test, the test was run in pin-on-disk mode in which a stationary pin (0.25 inches 52100 steel ball) is loaded against a rotating disk (52100 steel). The test was conducted at 100° C. at a 5N, a 20N, a 35N and a 50N load at a sliding speed of 1400 mm/s for 15 minutes at each load. The wear scars on the balls were measured as described above.

Tests results from the base oil alone (Example A), the base oil top-treated with a commercially available zinc dithiophosphate (Example B), and the base oil top-treated with caprolactam (Example C) are included for comparison purposes. Caprolactam is disclosed in U.S. Pat. No. 5,851,964 as an antiwear agent which can be used in conjunction with, or in place of, conventional engine oil antiwear additives such as ZnDTP. The MTM wear performance data are presented in Table 1.

TABLE 1

MTM Results in 100N Oil

| | Antiwear Additive | MTM Screener Wear Scar (μm) | MTM Load Increase Wear Scar (μm) |
|---|---|---|---|
| Ex. A | — | 350 | 570 |
| Ex. B | ZnDTP | 129 | 230 |
| Ex. C | Caprolactam | — | 392 |
| Ex. 4 | Glycidol | 103 | 260 |
| Ex. 5 | Butyl 2,3-epoxypropionate | 323 | 201 |
| Ex. 6 | N-Isopropyl 2,3-epoxypropionamide | 146 | — |
| Ex. 7 | N-Butyl 2,3-epoxypropionamide | 161 | — |

The results demonstrate that the lubricating oil compositions of the present invention demonstrate superior wear performance to known ashless antiwear additive caprolactam which polymerizes under rubbing conditions to form organic polymeric films directly on the rubbing surface in a manner similar to that proposed for the epoxide compounds of the present invention. While the lubricating oil composition containing butyl 2,3-epoxypropionate (Ex. 5) appears to perform poorly in the MTM screener, the same lubricating oil composition demonstrates superior load-carrying capacity in the MTM load increase profile.

Fully formulated lubricating oil compositions containing the epoxide compounds employed in the present invention were prepared and assessed for wear performance.

Example D (Comparative)

A baseline ZnDTP-free lubricating oil composition was prepared using the following additives:

(a) an ethylene carbonate post-treated succinimide;
(b) a high overbased calcium sulfonate;
(c) a low overbased calcium sulfonate:
(d) a foam inhibitor,
(e) a pour point depressant; and
(f) the balance, a mixture of Group II base oils.

Example E (Comparative)

A lubricating oil composition was prepared by top-treating the baseline formulation of Example D with 0.25 weight % of a ZnDTP derived from a mixture of secondary alcohols and with 0.15 weight % of a ZnDTP derived from a primary alcohol.

Example 8

A lubricating oil composition was prepared by top-treating the baseline formulation of Example D with 0.64 weight % of butyl 2,3-epoxypropionate as prepared in Example 1.

Example 9

A lubricating oil composition was prepared by top-treating the baseline formulation of Example D with 0.37 weight % of glycidol.

In the third MTM test, the MTM instrument was modified so that a ¼-in. diameter 1013 steel test ball that had not been hardened in the normal manufacturing process (soft ball) was used. The instrument was used in the pin-on-disk mode and run under sliding conditions. The area of material that is lost on the soft ball is recorded. Higher area values correspond to poorer wear performance of the oil. Test results are set forth in Table 2. Results are reported as an average of three runs.

TABLE 2

Test Results for MTM Pin on Disk Softball

| | Antiwear Additive | Area of Material Lost ($\mu m^2$) |
|---|---|---|
| Ex. D | — | 988 |
| Ex. E | ZnDTP | 921 |
| Ex. 8 | Butyl 2,3-epoxypropionate | 209 |
| Ex. 9 | Glycidol | 49 |

The results demonstrate that lubricating oil compositions containing epoxide compounds of the present invention afford superior wear protection.

Evaluation of Protection Against Corrosion

Example F (Comparative)

A zinc-free baseline lubricating oil composition was prepared and used for assessing the corrosion performance of the epoxide compounds of the present invention in the high temperature corrosion bench test (HTCBT). The baseline composition was prepared using the following additives: a borated succinimide, an ethylene carbonate post-treated succinimide, a high molecular weight polysuccinimide, a low overbased calcium sulfonate, a high overbased calcium phenate, a borated calcium sulfonate, a high overbased magnesium sulfonate, an alkylated diphenylamine, a hindered phenolic ester, a molybdenum complex, a foam inhibitor, a pour point depressant and a mixture of Group II base oils.

Example 10

A lubricating oil composition was prepared by top-treating the baseline formulation of Example F with 0.26 weight % of butyl 2,3-epoxypropionate as prepared in Example 1.

Example 11

A lubricating oil composition was prepared by top-treating the baseline formulation of Example F with 0.15 weight % of glycidol.

Example 12

A lubricating oil composition was prepared by top-treating the baseline formulation of Example F with 0.75 weight % of glycidol.

The corrosion protection of these lubricating oils was determined and compared in a standard ASTM Test No. D6594 (HTCBT) test for their capacity to protect the engine against corrosion. Specifically, four metal coupons including lead, copper, tin and phosphor bronze were immersed in a measured amount of the test oils. Air was passed through the oils at an elevated temperature for a period of time. When the test was completed, the coupons and stressed oils were examined to detect corrosion. Concentrations of lead, copper and tin in the stressed oils are reported in Table 3 below.

TABLE 3

HTCBT Results

| | Antiwear Additive | Concentration (wt. %) | Pb (ppm) | Cu (ppm) | Sn (ppm) |
|---|---|---|---|---|---|
| Ex. F | — | — | 282 | 24 | 0 |
| Ex. 10 | Butyl 2,3-epoxypropionate | 0.26 | 124 | 20 | 0 |
| Ex. 11 | Glycidol | 0.15 | 228 | 16 | 0 |
| Ex. 12 | Glycidol | 0.75 | 42 | 8 | 0 |

The results in Table 3 demonstrate that lubricating oil compositions of the present invention have improved lead and copper anti-corrosive capacity. Moreover, higher concentrations of an epoxide compound in the lubricating oil composition resulted in significantly improved lead and copper corrosion properties.

It is understood that although modifications and variations of the invention can be made without departing from the spirit and scope thereof, only such limitations should be imposed as are indicated in the appended claims.

What is claimed is:

1. A lubricating oil composition comprising (a) a major amount of an oil of lubricating viscosity; and (b) an oil soluble epoxide compound having the following structure:

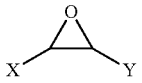

wherein X is hydrogen or a substituted or unsubstituted $C_1$ to $C_{20}$ hydrocarbyl group, wherein the substituted hydrocarbyl group is substituted with one or more substituents selected from hydroxyl, alkoxy, ester or amino groups and Y is —C(═O)OR$^1$, wherein R$^1$ is independently hydrogen or a $C_1$ to $C_{20}$ alkyl or alkenyl group; and further wherein the oil of lubricating viscosity does not contain a carboxylic acid ester.

2. The lubricating oil composition according to claim 1 wherein the $C_1$ to $C_{20}$ hydrocarbyl group of X is a straight- or branched-chain alkyl, cycloalkyl, alkcycloalkyl, aryl, alkaryl, or arylalkyl.

3. The lubricating oil composition according to claim 1 wherein the $C_1$ to $C_{20}$ hydrocarbyl group of X is an alkyl group of 1 to 6 carbon atoms.

4. The lubricating oil composition according to claim 1 wherein X is hydrogen.

5. The lubricating oil composition according to claim 1 wherein R$^1$ is butyl.

6. The lubricating oil composition according to claim 5 wherein X is hydrogen.

7. The lubricating oil composition according to claim 1 wherein the lubricating oil composition comprises no more than 0.08 weight % phosphorus.

8. The lubricating oil composition according to claim 7 wherein the lubricating oil composition is substantially free of phosphorus.

9. The lubricating oil composition of claim 1 further comprising one or more additives selected from metal detergents, ashless dispersants, oxidation inhibitors, rust inhibitors, demulsifiers, extreme pressure agents, zinc-containing wear inhibitors, friction modifiers, multifunctional additives, viscosity index improvers, pour point depressants, and foam inhibitors.

10. A lubricating oil additive concentrate comprising from about 90 weight percent to about 10 weight percent of an organic liquid diluent and from about 10 weight percent to about 90 weight percent of an oil soluble epoxide compound having the following structure:

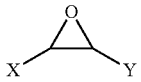

wherein X is hydrogen or a substituted or unsubstituted $C_1$ to $C_{20}$ hydrocarbyl group, wherein the substituted hydrocarbyl group is substituted with one or more substituents selected from hydroxyl, alkoxy, ester or amino groups and Y is —C(═O)OR$^1$, wherein R$^1$ is independently hydrogen or a $C_1$ to $C_{20}$ alkyl or alkenyl group; and further wherein the organic liquid diluent does not contain a carboxylic acid ester.

11. The lubricating oil additive concentrate according to claim 10 wherein the $C_1$ to $C_{20}$ hydrocarbyl group of X is a straight- or branched-chain alkyl, cycloalkyl, alkcycloalkyl, aryl, alkaryl, or arylalkyl.

12. The lubricating oil additive concentrate according to claim 10 wherein the $C_1$ to $C_{20}$ hydrocarbyl group of X is an alkyl group of 1 to 6 carbon atoms.

13. The lubricating oil additive concentrate according to claim 10 wherein X is hydrogen.

14. The lubricating oil additive concentrate according to claim 10 wherein R$^1$ is butyl.

15. The lubricating oil composition according to claim 14 wherein X is hydrogen.

16. A method for reducing wear in an internal combustion engine, the method comprising operating the internal combustion engine with the lubricating oil composition according to claim 1.

17. A method for reducing wear in an internal combustion engine, the method comprising operating the internal combustion engine with the lubricating oil composition according to claim 6.

18. The lubricating oil composition of claim 1, wherein the epoxide compound is present in the lubricating oil composition in an amount of from about 0.01 to about 8 weight %, based on the total weight of the composition.

19. The lubricating oil composition of claim 1, wherein the epoxide compound is present in the lubricating oil composition in an amount of from about 0.05 to about 5 weight %, based on the total weight of the composition.

20. The lubricating oil composition of claim 1, wherein the epoxide compound is present in the lubricating oil composition in an amount of from about 0.1 to 2 weight %, based on the total weight of the composition.

* * * * *